United States Patent [19]

Berdan

[11] Patent Number: 4,850,175

[45] Date of Patent: Jul. 25, 1989

[54] SPACER ASSEMBLY FOR MULTIPLE GLAZED UNIT

[75] Inventor: Gunter Berdan, Weston, Canada

[73] Assignee: Indal Limited, Weston, Canada

[21] Appl. No.: 849,169

[22] Filed: Apr. 7, 1986

[30] Foreign Application Priority Data

Nov. 7, 1985 [CA] Canada ..... 494802

[51] Int. Cl.[4] ..... E06B 7/12; E06B 3/64

[52] U.S. Cl. ..... 52/790; 52/172; 52/304; 52/656; 52/658; 52/788

[58] Field of Search ..... 52/304, 656, 657, 658, 52/172, 788, 790, 171, 785, 786

[56] References Cited

U.S. PATENT DOCUMENTS

| | | | |
|---|---|---|---|
| 2,011,557 | 8/1935 | Anderegg | 52/304 |
| 2,118,032 | 5/1938 | Gibson | 52/656 |
| 2,387,119 | 10/1945 | Clerk . | |
| 2,872,713 | 2/1959 | Haas | 52/788 |
| 2,993,242 | 7/1961 | Leisibach | 52/304 |
| 3,307,316 | 3/1967 | Gray . | |
| 3,308,593 | 3/1967 | Smith . | |
| 3,327,766 | 6/1967 | Kurz . | |
| 3,376,670 | 4/1968 | Jones . | |
| 3,775,914 | 12/1973 | Patil . | |
| 3,783,084 | 1/1974 | Quenett . | |
| 3,965,638 | 6/1976 | Newman | 52/790 |
| 4,030,263 | 6/1977 | Lacombe . | |
| 4,057,945 | 11/1977 | Kessler . | |
| 4,073,177 | 2/1978 | Leroux . | |
| 4,080,482 | 3/1978 | Lacombe . | |
| 4,109,432 | 8/1978 | Pilz . | |
| 4,149,348 | 4/1979 | Pyzewski . | |
| 4,193,236 | 3/1980 | Mazzoni et al. . | |
| 4,222,213 | 9/1980 | Kessler . | |
| 4,223,499 | 9/1980 | Schrunk | 52/656 |
| 4,232,492 | 11/1980 | Remick et al. . | |
| 4,268,553 | 5/1981 | Marzouki et al. | 52/790 |
| 4,372,094 | 2/1983 | Boschetti | 52/788 |
| 4,464,874 | 8/1984 | Shea, Jr. et al. | 52/304 |
| 4,592,179 | 6/1986 | Boutarin | 52/304 |
| 4,607,468 | 8/1986 | Paquet | 52/790 |
| 4,608,796 | 9/1986 | Shea, Jr. | 52/304 |

FOREIGN PATENT DOCUMENTS

| | | | |
|---|---|---|---|
| 900571 | 1/1985 | Belgium | 52/790 |
| 177333 | 5/1917 | Canada . | |
| 481581 | 3/1952 | Canada . | |
| 627911 | 9/1961 | Canada . | |
| 692563 | 8/1964 | Canada . | |
| 754862 | 3/1967 | Canada . | |
| 901882 | 6/1972 | Canada . | |
| 981527 | 1/1976 | Canada . | |
| 1006051 | 3/1977 | Canada . | |
| 1008307 | 4/1977 | Canada . | |
| 1042724 | 11/1978 | Canada . | |
| 1053080 | 4/1979 | Canada . | |
| 1143221 | 3/1983 | Canada . | |
| 1153628 | 9/1983 | Canada . | |
| 1165627 | 4/1984 | Canada . | |
| 1172515 | 8/1984 | Canada . | |
| 0023412 | 4/1979 | European Pat. Off. . | |
| 0053251 | 6/1982 | European Pat. Off. | 5/788 |

(List continued on next page.)

*Primary Examiner*—Carl D. Friedman
*Assistant Examiner*—Michael Safavi
*Attorney, Agent, or Firm*—Nixon & Vanderhye

[57] ABSTRACT

A spacer tube design is arranged to receive a snap-on cap which may be of any desired color thereby to match the surrounding structure. The spacer tube can be bent into a rectangular outline shape without the use of separate corner inserts. The snap-on cap may be capable of holding a deisiccant material. The cap may be also designed as to provide thermal and/or sound insulation between the glazing panels and/or to securely hold a decorative grill or the like in place between the glazing panels. The spacer unit may be capable of flexing in such a manner as to accommodate relative movement between the glazing units in response to fluctuations in the forces acting on the glazing panels thereby to reduce the possibility of damage occurring to the glazing unit.

25 Claims, 5 Drawing Sheets

FOREIGN PATENT DOCUMENTS

| | | | |
|---|---|---|---|
| 1434283 | 10/1968 | Fed. Rep. of Germany | 52/172 |
| 1918528 | 11/1970 | Fed. Rep. of Germany . | |
| 2031576 | 12/1971 | Fed. Rep. of Germany . | |
| 2333156 | 1/1975 | Fed. Rep. of Germany . | |
| 2526438 | 12/1976 | Fed. Rep. of Germany . | |
| 2730264 | 1/1979 | Fed. Rep. of Germany | 52/788 |
| 2743577 | 4/1979 | Fed. Rep. of Germany . | |
| 2907838 | 9/1980 | Fed. Rep. of Germany . | |
| 3044179 | 6/1982 | Fed. Rep. of Germany . | |
| 8204453 | 7/1982 | Fed. Rep. of Germany . | |
| 3117615 | 11/1982 | Fed. Rep. of Germany . | |
| 3203808 | 8/1983 | Fed. Rep. of Germany . | |
| 3403275 | 8/1985 | Fed. Rep. of Germany . | |
| 1560769 | 3/1969 | France . | |
| 2552153 | 3/1985 | France | 52/790 |
| 8501774 | 4/1985 | PCT Int'l Appl. | 52/172 |
| 515085 | 11/1939 | United Kingdom | 52/172 |
| 1273625 | 5/1972 | United Kingdom . | |
| 1297004 | 11/1972 | United Kingdom . | |
| 2007750 | 5/1979 | United Kingdom . | |
| 2023209 | 12/1979 | United Kingdom . | |
| 1567983 | 5/1980 | United Kingdom . | |
| 2077833 | 12/1981 | United Kingdom | 52/790 |
| 2077834 | 12/1981 | United Kingdom | 52/788 |
| 2114201 | 8/1983 | United Kingdom . | |

SPACER ASSEMBLY FOR MULTIPLE GLAZED UNIT

BACKGROUND OF THE INVENTION

This invention relates generally to multiple glazed units and in particular to an improved spacer assembly for spacing apart the glass panes or glazing panels of such a unit.

As is well known in the art, in multiple glazed units, two or more glazing panels are secured in spaced apart parallel relationship to one another by peripheral edge spacers and adhered thereto by a suitable sealing composition applied between each panel and and the spacer. The spacer is often a hollow tubular spacer and it usually contains a desiccant to absorb moisture from the space between the glazing panels to thus avoid condensation problems. In the case of tubular spacers, the same are commonly roll-formed into the desired profile shape.

Many conventional spacer designs do not provide adequate space or room for the desiccant material. Hence, after a period of time, the moisture absorbing capability of the desiccant is exceeded and condensation begins to appear on the interior surfaces of the glazing panels.

Another problem common to conventional spacer designs is related to the fact that the inner wall of the spacer is readily visible and often presents a rather undesirable appearance in that it is not of the same colour as the frame surrounding the glazing unit. It is not practical to produce and market differently coloured spacer bars.

Another difficulty inherent in the pesent spacer arrangements is that they typically provide an easy path for the transmission of heat from one glazing panel to the other. As a result of this, under low temperature conditions, a frost line around the perimeter of the glazing unit is often present. Another problem is that a rigid spacer provides an excellent path for the transmission of sound from the outer panel to the inside panel. This poses a particular problem in high-noise areas such as airports. Other institutions such as hospitals also have a need for low sound transmission glazing units.

Another problem with conventional glazing units is related to the problem of deflection of the glazing panels under the influence of high winds, traffic noise, or internal pressure changes owing to expansion or contraction of the air mass contained within the glazing unit. This action imposes high stresses on the glazing panels and can break the seal between the spacer and the glazing units thus allowing moisture to enter and in extreme cases breakage of the glazing panel can occur.

Since the spacer must extend completely around the marginal portion of the glazing unit, special provisions must be made for the corners. In the most common constructions used to date, the spacer is miter-cut at the corner locations and spliced together by means of a special corner pieces. This creates a number of problems since the corner pieces and the required assembly procedure increases manufacturing costs substantially; moreover the spacer assembly is weaker at these corners and the corner piece assembly often affords a path for moisture to seep into the interior of the glazed unit from the outside.

Efforts have been made in the past to provide a spacer bar arrangement having right angle bends at the corners; however these designs do not appear to have found wide acceptance apparently because the bending process causes substantial distortion of the spacer tube profile and moreover, the strength at the bend is often significantly impaired.

In other instances it may be desirable to use muntin bars between the panes for decorative or reinforcement purposes. In the past it has been a problem to secure them securly to the spacers so there is no danger of them slipping out of position in response to vibration and the like.

SUMMARY OF THE INVENTION

It is therefore a basic object of the invention to provide an improved spacer for a multiple glazed unit which solves or alleviates the problems noted above.

It is a further object of the invention to provide a spacer tube design which is arranged to receive a snap-on cap. A further object is to provide a spacer tube arrangement having a snap-on cap of any desired colour thereby to match the surrounding structure. Another object is to provide a spacer tube which can be bent into a rectangular outline shape without the use of separate corner inserts. A further object is to provide a spacer with a snap-on cap which is capable of holding a desiccant material. A still further object is to provide a spacer arrangement including a filler cap so designed as to provide thermal and/or sound insulation between the glazing panels. A further object is to provide a spacer arrangement incorporating a filler cap having suitable means therein to securely hold a decorative grill or the like in place between the glazing panels. A further important object is to provide a spacer unit which is capable of flexing in such a manner as to accommodate relative movement between the glazing units in response to fluctuations in the forces acting on the glazing panels thereby to reduce the possibility of damage occuring to the glazing unit.

Accordingly the invention herein concerns improvements in a spacer including a tubular body having a inner web which in use faces inwardly toward the space between the pair of glazing panels and an outer web which in use faces in the opposite direction away from the panels. The spacer includes a pair of elongated flanges disposed at opposing sides of the tubular spacer in flanking relation to the inner web. Each flange includes an inner and an outer wall with the outer flange walls lying outboard of the remainder of the tubular spacer and normally being generally parallel to one another so that they may be positioned in proximity to or in abutting relation to the inner surfaces of the glazing panels when in use.

As a very desirable feature of the invention the inner flange walls have a configuration such that the distance between them becomes smaller a selected distance away from the inner web thereby to define a re-entrant or dovetail-like region bounded by the inner flange walls and the inner web. This arrangement facilitates the securement to the flanges and over the inner web of a snap-on cap.

The above-noted re-entrant region may be provided in several ways. The inner flange walls may gradually decrease in a direction away from the inner web such as by being inclined toward each other in a direction away from the inner web or alternatively the inner flange walls may each have a convex hump thereon to provide the gradual reduction in distance. Alternatively the distance between the inner flange walls may decrease abruptly as by providing an abrupt step to provide the re-entrant region.

In the preferred form of the invention the tubular body includes, in addition to the above-noted inner and outer webs, a pair of opposed body side walls which extend between the outer web and the flange outer walls. A shoulder portion between each body side wall and the associated flange outer wall defines an inwardly directed step by way of which the body sidewalls are stepped inwardly of the flange outer walls. In use, a sealant material occupies the space provided by the these inwardly directed steps between the body sidewalls and the inner walls at the edges of the glazing panels.

As a further feature of the invention the flange outer walls are spaced from the flange inner walls thereby to permit inward or outward movement of the flange outer walls during use in response to pressure fluctuations on glazing panels engaged with same. The flanges are also capable of flexing and pivotting relative to the tubular body of the spacer to accommodate flexure of glazing panels in contact therewith. This feature reduces glazing panel breakage and breakage of the seal between the panels and the spacer as a result of these pressure fluctuations etc.

As a further feature of the invention the spacer may include at least one smoothly contoured right angle bend therein adapted to be positioned at a corner of the glazing unit.

The invention further provides a glazing unit including a spaced pair of glazing panels and a spacer as described herein extending around the perimeter of the unit between the panels and sealingly engaged therewith. The spacer will be provided with a smoothly contoured right angle bend at each of the corners of the glazing unit.

As a further important feature of the invention the spacer as described includes a snap-on cap, such cap having resilient portions engaged with the inner flange walls of the spacer to releasable secure the cap to the spacer body. Preferably the cap defines a space between itself and the inner web of the spacer, such space in use holding a suitable desiccant material.

In a preferred form, the snap-on cap includes a top wall with the resilient portions thereof being in the form of a pair of resilient legs extending from the top wall in spaced apart relationship. The outer distal end of each leg may have an outwardly turned lip adapted to engage with the inner flange wall portion and to cooperate therewith so that during installation or removal of the cap such legs spring inwardly to provide the desired snap action.

The cap may be of roll formed or extruded metal pre-painted in the desired colour to provide a pleasing appearance when in use. In an important alternative arrangement the cap may be of a resilient plastic material and may include oppositely directed lobes engaged with abrupt steps defined by the inner flange walls of the spacer to secure the cap in place. In this case the cap itself defines an elongated cavity for retention of desiccant and apertures are provided in the cap for communicating the space between the glazing panels with the desiccant cavity.

In another version the cap includes down turned strips along each of the longitudinal margins of its top wall, which strips are arranged to overlie substantial portions of the flange outer walls so that in use these strips are interposed between the flange outer walls and the glazing panels. As a further important feature, the cap is of a suitable plastic material and the down-turned strips noted above are of sufficient thickness that in use they provide thermal insulation and/or sound insulation between the glazing panels. As will be readily apparent this thermal insulating capability is of importance in improving the heat loss characteristics of a building structure and reduces problems of condensation and frost line formation resulting from thermal transmisson. The improvement in sound insulation is of particular value in noisy environments and in places where low sound transmisson is desired as in hospitals.

The glazing unit, according to a still further feature of the invention, includes a snap-on cap engaged with the flanges of the spacer, such cap having a top wall overlying the inner web of the spacer body. A series of muntin bars are arranged in a selected array between the glazing panels for decorative and/or reinforcement purposes. The snap-on cap is provided with means, such as suitable apertures receiving end portions of the muntin bars, for securing the muntin bars in position thereby to resist vibration forces and the like.

In a still further major aspect of the invention there is provided a spacer including a tubular body and having a pair of outwardly and oppositely facing walls which are normally in paallelism with one another and which are adapted to engage or abut the inner surfaces of the spaced glazing panels when in use. The tubular spacer body is constructed so as to provide flexible inner and outer structures which serve to connect the oppositely facing walls with one another in such a fashion that the oppositely facing walls are capable of moving toward or away from one another and/or to rotate slightly relative to one another in response to pressure fluctuations and/or flexure of the glazing panels in contact therewith.

As a still further aspect of the invention there is provided a glazing unit comprising an elongated tubular spacer positioned between a pair of glazing panels adjacent the perimeter of same. The spacer includes a tubular body and means thereon defining a pair of oppositely directed wall portions arranged parallel to and in juxtaposition to the inner surfaces of the glazing panels. The tubular body includes an inner web portion facing inwardly toward the space defined between the panels and an elongated snap-on cap is engaged with the spacer in overlying relation to the inner web portion.

Further aspects and features of the invention will become apparent from the following description of preferred embodiments of same coupled with the accompanying claims.

BRIEF DESCRIPTION OF THE VIEWS OF DRAWINGS

DETAILED DESCRIPTION OF THE PREFERRED EMBODIMENTS

Figure 1:
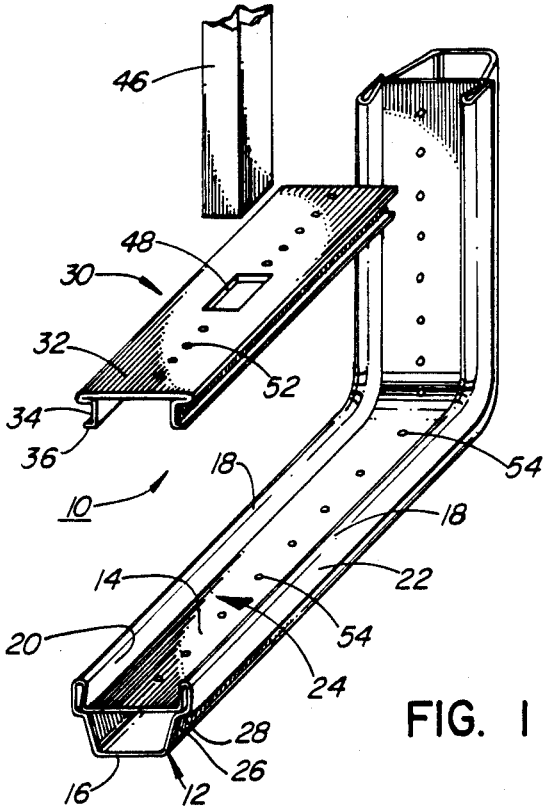
FIG. 1 is an exploded perspective view showing a portion of the spacer adjacent a corner as well as a portion of its snap-on cap and a muntin bar.

With reference now to FIG. 1 there is shown an elongated spacer 10 adapted to be positioned between a pair of glazing panels adjacent the perimeters of same. The spacer includes a tubular body 12 having an inner web 14 which, in use, faces inwardly toward the space between the glazing panels, and an outer web 16 which, in use, faces outwardly in the opposite direction away from the panels. The spacer further includes a pair of elongated flanges 18 disposed at opposing sides of the tubular body in flanking relation to the inner web 14. Each flange 18 includes an inner wall 20 and an outer wall 22. The outer flange walls 22 lie in positions outboard of the remainder of the tubular spacer and these walls 22 are normally positioned in parallelism with one another. These walls are adapted to be positioned in proximity to or to abut the inner surfaces of the glazing panels when in use.

The inner flange walls 20 have a configuration such that the distance between them becomes smaller a selected distance away from the inner web 14 thereby to define a re-entrant or dove tail groove-like region which, as described hereafter, facilitates the securement to the flanges 18 and over the inner web 14 of a snap-on cap.

With continued reference to FIG. 1 as well as to FIGS. 4, 5, 10 and 11, it will be seen that the inner flange walls 20 are inclined toward each other in a direction away from the inner web 14 to provide a gradual reduction in distance in the direction away from the inner web 14 thereby to define a dove tail groove-like region.

The spacer includes a snap-on cap 30 as illustrated in the drawings and with particular reference to FIG. 1 it will be seen that the cap 30 includes a top wall 32 and a pair of resilient legs 34 extending downwardly from positions located inwardly of the margins of the top wall 32 and in a spaced apart relation. The outer distal end of each leg 34 is provided with an outwardly turned lip 36, which lips 36 are adapted to engage with the respective flange inner walls 20 and to cooperate therewith such that during installation or removal of the cap 30 on the spacer body, these legs 34 are caused to spring inwardly toward each other to provide a snap action.

Returning now to the spacer body itself, it will be seen that it includes, in addition to the inner and outer webs 14 and 16, a pair of opposed body side walls 26. Side walls 26 extend between the margins of the outer web 16 and the flange outer walls 22. A shoulder portion 28 is defined between each body side wall 26 and the associated flange outer wall 22, which shoulder defines an inwardly direct step by way of which the body side walls 26 are stepped inwardly of the flange outer walls 22.

Figure 2:
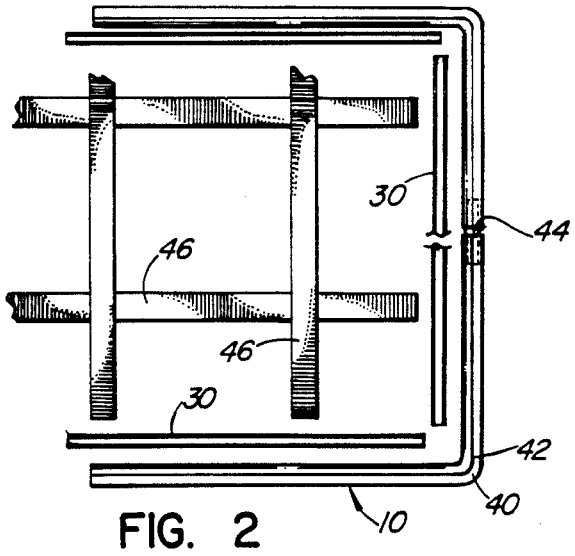
FIG. 2 is an exploded side elevation view of a portion of the spacer bar, cap and muntin bar or grill assembly.
Figure 3:
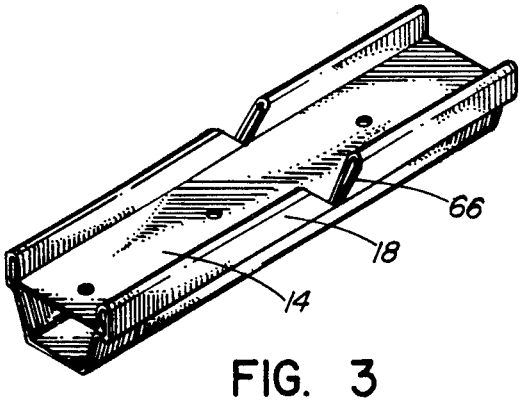
FIG. 3 is a perspective view of a portion of a spacer illustrating miter cut outs at the bend area.

With reference to FIG. 2, in the assembly of the glazing unit, the spacer 10 is provided with suitably spaced apart 90 degree bends illustrated as item 40. This 90 degree bend is accomplished with the aid of a fixture (not shown) which provides the bend with a relatively small generally circular curve 42. It has been found that the spacer tube configurations described herein are well suited for bending without significant buckling or distortion problems. By providing a small circular curve, buckling of the spacer flanges 18 is substantially avoided without the need for effecting miter cut outs in the flanges unless the flanges are relatively deep, in which event the flanges may be cut as shown in FIG. 3. This corner bend provides for a very sturdy and rigid corner arrangement considering the stiffness imparted by flanges 18 as well as the box beam-like tubular spacer body.

Figure 5:
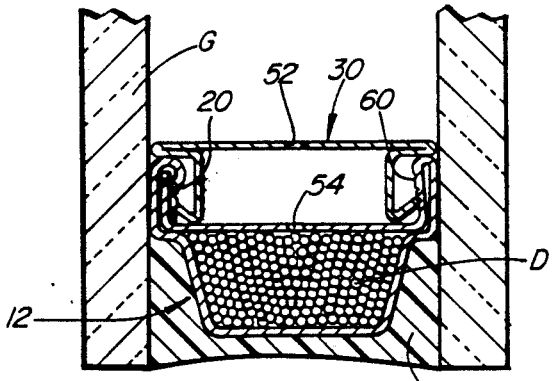
FIG. 5 is a cross-section similar to that of FIG. 4 but illustrating the desiccant as located inside of the tubular spacer body.
Figure 6:
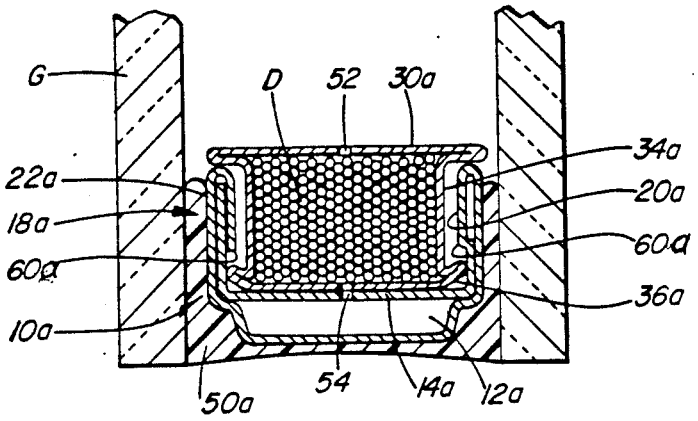
FIG. 6 is a further cross-section of the glazing unit illustrating the modified form of spacer tube and its snap-on cap, the cap being of a relatively deep profile with the desiccant located in the cap.
Figure 7:
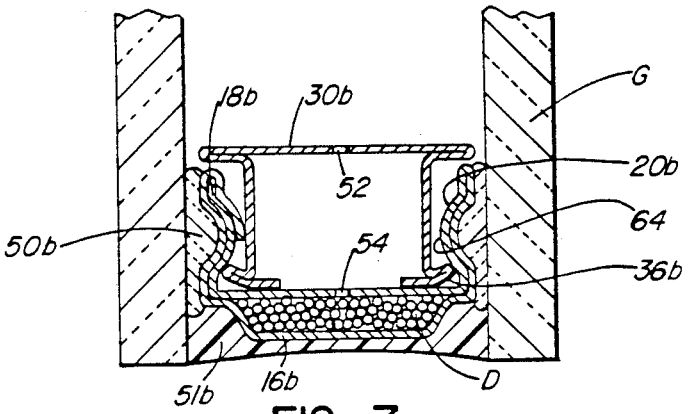
FIG. 7 is a section view similar to that of FIG. 6 but illustrating the use of desiccant within the tubular spacer itself and also showing a dual sealant system.

It should be noted here that in the case where the tubular body is provided with relatively deep flanges 18*a*, 18*b* as illustrated in FIGS. 6 and 7, that it may be necessary to miter cut the flanges as illustrated in FIG. 3 prior to effecting the 90° bends shown in FIG. 2. These miter cuts are designated by a reference characters 66. Miter cuts 66 can also be used in the embodiments of FIGS. 1 and 4–5 if a relatively sharp corner bend is desired. However, in all cases, care should be taken not to cut through the inner web 14 of the spacer as this would tend to unnecessarily weaken the spacer at the corner position and also allow desiccant leakage.

The spacer 10, after bending, is assembled together as required using a straight connector plug 44 at each of the joints in the spacer. Each joint is located between the corners 40 in a straight section of the spacer.

After the spacer has been bent as required and assembled together utilizing the plugs 44, its elongated caps 30 are snapped into place such that they interengage with the flange inner walls 20 as previously described.

In certain installations it may be desirable to provide a decorative and/or reinforcing arrangement of muntin bars 46 as illustrated in FIG. 2. As shown here the muntin bars 46 are arranged in a rectangular grid-like array, commonly referred to as a colonial grill. In order to secure the array of muntin bars in position, the snap-on caps 30 are provided with spaced apart apertures 48 which receive the ends of the muntin bars 46 thereby holding the colonial grill firmly in position and preventing dislodgement of same and possible damage to the glazing panels in the event of vibration and the like.

Figure 4:
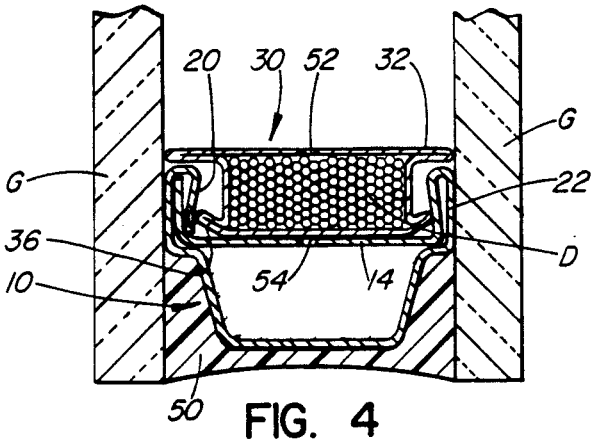
FIG. 4 is a cross-section view of a portion of a glazing unit illustrating the spacer tube and desiccant filled snap-on cap and a sealant material for sealing a spacer to the glazing panel.

Reference will now be had particularly to FIGS. 4–9 which illustrate cross-sectional views of peripheral edge portions of glazing units incorporating spacer assemblies in accordance with the present invention. In FIGS. 4 and 5 the spacer 10 is shown together with its snap-on cap 30, the spacer 10 being sealingly engaged with the glazing panels G by means of a suitable sealant material 50. It should be noted from FIGS. 1, 4 and 5 that the top wall 32 of the cap is provided with a series of small breather holes 52. The inner web 14 is likewise provided with a series of spaced apart breather holes 54. As shown in FIG. 4, the elongated rectangular space provided between the top wall 32 of the snap-on cap and the bottom wall of the cap is filled with a suitable desiccant. The breather holes 52 provide a way for the moisture trapped between the glazing panels G to migrate into the desiccant D.

FIG. 5 illustrates a very similar form of structure. Insofar as structural changes are concerned it will be noted that the flange inner walls 20 are provided with spaced apart longitudinal grooves 60. These grooves 60 provide a means whereby the outwardly turned lips 36 of the snap-on cap 30 more positively engage with the inner flange walls 20 thereby to strongly resist removal of snap-on cap 30. In FIG. 1, for example, this resistance to removal of the snap-on cap is somewhat less since in this case the resistence to removal is provided by the inward incline of flange inner walls 20 and the outward bias of the legs 34 causing the outwardly turned lips 36 to engage with these inner walls 20. Further, in the embodiment of FIG. 5, it will be noted that the hollow body 12 of the spacer is itself filled with the desiccant D and that the upper chamber defined below the top wall of cap 30 is empty. The moisture migrates into the desiccant D by way of the previously described breather holes 52 and 54. In the arrangement shown in FIG. 5 the snap-on cap 30 provides a decorative function, it being kept in mind that in all cases, the snap-on cap is coloured such as to provide an attractive appearance when seen from the outside of the glazing unit.

It should also be kept in mind that in the event additional desiccant is required it is also possible to fill the space below the top wall of the cap 30 with desiccant as illustrated in FIG. 4.

Referring now to FIG. 6 a modified form of spacer with cap is illustrated. The spacer **10*a* incorporates the basic features described previously with reference to Figure 4 except that the flanges 18*a* are of greater highth than described previously while the tubular body portion 12*a* is relatively shallow. The legs of the cap 34*a* are correspondingly greater in highth as compared with those described previously. Furthermore, the flange inner walls 20*a* are not inclined in the manner described previously but, rather, such inner walls are arranged so as to provide small but abrupt steps 60*a*, which steps 60*a*, as shown in FIG. 6, are positioned as to interfere with the outwardly turned lips 36*a*** of the snap-on cap thereby to strongly resist removal of the snap-on cap.

The relatively deep snap-on cap illustrated in FIG. 6 is provided, as before, with breather holes 52 while the spacer body is provided with breather holes 54. The relatively large depth of the cap **30*a* permits a very large quantity of desiccant D to be positioned within the space defined between the top of the snap-on cap and the bottom wall of the cap. The sealing compound is illustrated as 50*a* in FIG. 6, it being noted that the sealing compound has been forced upwardly into a position between the flange outer walls 22*a*** and the glazing panels G.

FIG. 7 illustrates a spacer arrangement similar to that of FIG. 6. However, it will be noted that the flange inner walls 20b are provided with a longitudinally extending convex hump 64, which convex hump provides the re-entrant region referred to previously, with the outwardly turned lips **36*b* of the cap being engaged beneath these humps 64 to securely retain the snap-on cap 30*b* in position. In the arrangement of FIG. 7**, the desiccant D is shown as being positioned in the relatively small chamber provided by the low-highth tubular spacer body. However, it should be kept in mind that the upper chamber or region defined below the top wall of the snap-on cap may be filled with desiccant D if conditions require an extra amount of desiccant.

The FIG. 7 embodiment is also suitable for use with dual sealant systems. It will be noted here that a first sealing compound **50*b* is interposed between the flange outer walls and the glazing units G, such sealant filling the concave recess as provided in the flange outer walls. This provides the primary sealing function while the secondary sealing function is provided by sealant by sealant 51*b* which occupies the remaining space and covers the outer web 16*b*** of the spacer etc.

Figure 8:
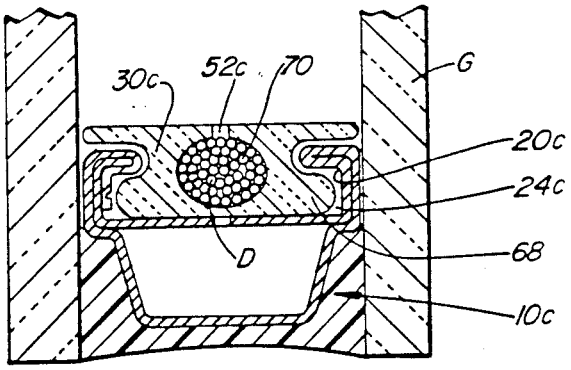
FIG. 8 is a further section view illustrating a spacer tube similar to that of FIGS. 4 and 5 showing the use of a deformable plastic snap-on cap of modified design, which cap has a longitudinal cavity filled with desiccant.
Figure 9:
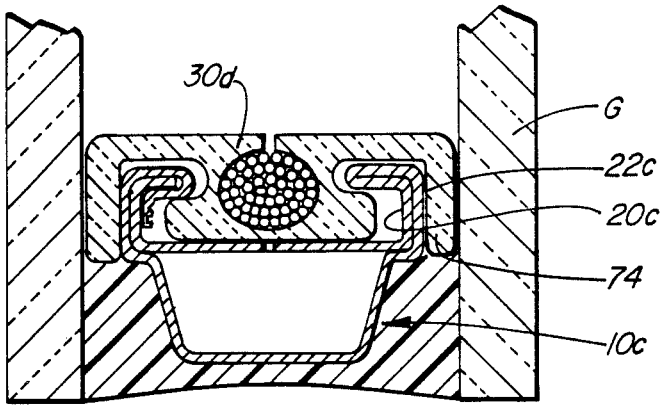
FIG. 9 is a further section view similar to that of FIG. 8 but illustrating a modified cap arrangement which provides thermal and/or sound insulation.
Figure 10:
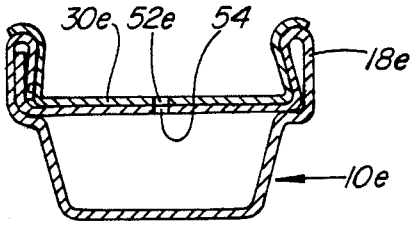
FIG. 10 is a further section view of a spacer tube and cap assembly only, the snap-on cap being adapted to provide a desired colour only.

With reference now to FIGS. 8 and 9, modified forms of snap-on caps **30*c* and 30*d* are illustrated. The body of spacer 10*c* in both embodiments is similar to that described in FIGS. 1, 4 and 5 except that the flanges thereof have been modified so that the inner flange wall 20*c* defines an abrupt inward step whereby to define the re-entrant or dove tail-like groove 24*c*. With particular reference to FIG. 8 it will be seen that the snap-on cap 30*c* is of a Nylon, fiberglass or Neoprene rubber material. The use of certain plastic materials which create vapours when heated during hot sunny days is to be avoided. The cap includes oppositely directed lobes 68 extending the length thereof, which lobes are engaged with the abrupt steps defined by the flange inner walls 20*c*. This arrangement serves to secure the cap 30*c* in place. With further reference to FIG. 8 it will be seen that the cap defines an elongated cavity 70 for retention of desiccant D. Breather holes 52*c*** in the top wall of the snap-on cap provide communication between desiccant D and the space between the glazing panels G.

A modified form of cap arrangement **30*d* is illustrated in FIG. 9. The basic configuration of the cap 30*d* is the same as that described with reference to cap 30*c* in FIG. 8; however in the arrangement of FIG. 9, the cap 30*d* further includes down turned strips 74 along each of the longitudinal margins of the top wall of the cap, which strips 74 are arranged to overlie the flange outer walls 22*c*. Thus, it will be seen that these strips 74 are interposed between the flange outer walls and the glazing panels G. By making these down turned strips 74** of sufficient thickness and by making the cap of a suitable thermal insulating or sound absorbing material such as fiberglass or neoprene rubber, a substantial degree of thermal insulation and sound insulation is provided between the glazing panels thus reducing heat and/or sound transmission from one glazing panel G to the next.

With reference to FIG. 10, the spacer 10 is again shown which in itself conforms with that illustrated in FIG. 1. A very simple form of snap-on cap **30*e* is provided which is arranged such that no space is provided between itself and the inner web 14 of the spacer. This snap-on cap 30*e* is provided for decorative purposes only. As described previously, it is painted or otherwise coated so as to provide an attractive overall appearance to the structure. Suitable vent holes 52***e* and 54 are provided as described previously.

Figure 11:
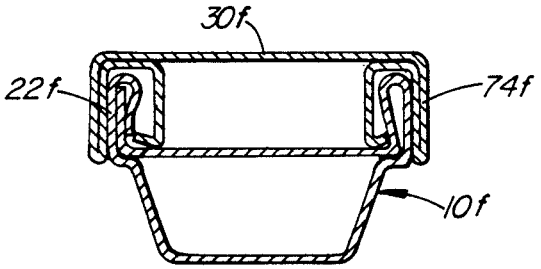
FIG. 11 is a further section view illustrating a cap configuration generally similar to that of FIG. 9 but lacking any thermal break or soundproofing means.

In the structure of FIG. 11 a still further form of snap-on cap 30*f* is provided. This snap-on cap includes the basic feature of the snap-on cap described with reference to FIGS. 1, 4 and 5 except that it also includes down turned marginal side portions 74*f* which overlie the flange outer walls 22*f*. Again, this snap-on cap 30*f* is utilized here primarily for decorative purposes and is painted or otherwise coated to provide the desired colour effect.

Figure 12:
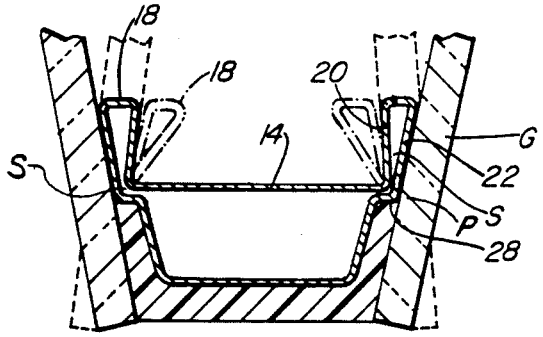
FIG. 12 is a further section view of a glazing unit illustrating the flexing action of the spacer in response to typical motions of the marginal portions of the glazing panels.
Figure 13:
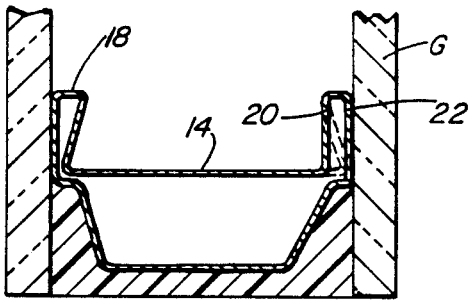
FIG. 13 is a view similar to that of FIG. 12 illustrating the manner in which the spacer expands and contracts in response to pressure fluctuations acting on the glazing units.

A further important feature of the improved spacer design is illustrated in FIGS. 12 and 13. It is of It was previously noted that changes in the forces acting on the glazing panels G imposed large stresses on such panels thus, in some cases, causing cracking and breakage of the panels and/or disruption of the seal between the panels thus allowing the ingress of moisture.

It was previously noted that there is a space between the inner and outer flange walls 20 and 22. course clear from the drawings that the inner and outer flange walls 20, 22 are connected to each other only along distal portions of the flanges 18, i.e. portions remote from inner web 14. It will also be noted that there is a small gap between the opposing ends of the inner web 14 and flange outer wall 22 just above shoulder 28 and designated by reference character S. By virtue of these clearance spaces it will be appreciated that the flange outer walls 22 are free to move back and forth slightly relative to one another and that moreover, the flanges 18 are capable of pivotting slightly relative to the spacer body about the pivot point P as illustrated in FIG. 12. The full line and dashed line positions of the glazing panels G and flanges 18 are exaggerated for purposes of illustration. In actual practice the amount of deflection will be quite small; nevertheless it is definitely present and unless freedom of movement is permitted by virtue of the arrangement illustrated in FIG. 12, serious damage may occur. By allowing the pivotting action illustrated in FIG. 12 to take place, a reduction in breakage owing to pressure fluctuations etc. will be noticed and moreover there should be less disruption of the sealant arising from such causes.

With reference to FIG. 13, expansion and contraction of the air between the glazing panels G causes them to move inwardly or outwardly slightly and, by virtue of the space between the inner and outer flange walls 20 and 22 as well as the clearance space S noted above, the flange outer walls 22 can move toward and away from one another thereby decreasing the stresses imposed on the glazing panels G and assisting in avoiding disruption of the seal between such panels.

Figure 14:
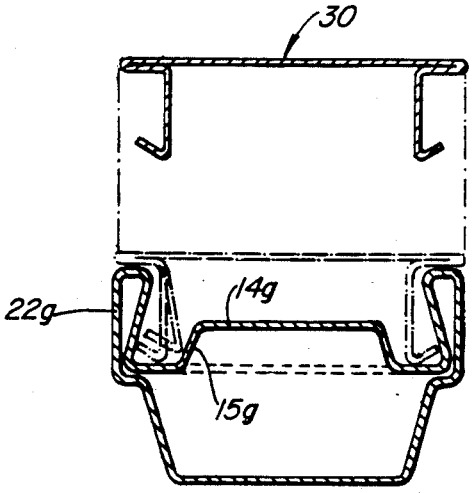
FIG. 14 is a view of a modified form of spacer incorporating a raised central or internal web portion.

A further modification of the spacer is illustrated in FIG. 14. In this modification the inner web 14*g* includes a raised central portion defining oppositely disposed downwardly extending ramp portions 15*g*. These downwardly extending and outwardly sloping ramp portions 15*g* aid in locating the snap-on cap 30 and they can assist in pushing the legs 34 outwardly towards the sides of the spacer for more secure holding power. Furthermore, the raised central portion increases the size of the cavity defined by the spacer body thereby enabling it to hold more desiccant.

The spacer structures herein described including the snap-on caps may be readily formed from sheet aluminum by convention roll-forming techniques. Seams and the like may be locked tight by use of a staking wheel which contains small teeth to stake the metal. Alternatively, the seams in the spacer tube can be seam-welded. Alternatively, the aluminum sections could be extruded; in the case of the snap-on caps illustrated in FIGS. 8 and 9 the nylon cap is of course extruded.

Conventional desiccant materials may be utilized. The desiccant may be poured into the end of the cavity defined by the tubular spacer body or the spacer tube may be filled during the rollforming process before the seam is closed up. In the case where the desiccant is to be retained by the snap-on cap, the desiccant first of all may be placed in tea-bag type pouches with the latter being subsequently placed in the cap at suitable locations to provide the desired effect.

By using the snap-on cap, in addition to the advantages noted previously, the manufacturers logo and date stamp may conveniently be applied to the cap.

Numerous variations and modifications will readily occur to those skilled in this art upon reading the above description, and without departing from the spirit or scope of the invention. For definitions of the invention reference is to be had to the appended claims.

I claim:

1. An elongated spacer adapted to be positioned between a pair of glazing panels adjacent the perimeter thereof, said spacer including a tubular body having an inner web which, in use, faces inwardly toward the space between the panels and an outer web spaced from said inner web and which, in use, faces outwardly in the opposite direction away from the space between the panels, said spacer including first and second elongated flanges disposed at opposing sides of said tubular body in flanking relation to said inner web and each said flange having an inner and an outer wall, with a groove-like region being defined and bounded by said inner web and said inner flange walls, each said flange having a distal portion remote from said inner web and a proximal portion adjacent said inner web, and said inner web extending fully across from said first flange to said second flange, said inner and outer walls of at least said first flange being directly connected together only at said distal portion thereof, and, adjacent the proximal portion of said first flange, said inner wall of said first flange being connected only to said inner web, said tubular body further including a pair of oppposed body side walls each of which extends between an associated flange outer wall and said outer web, said outer flange walls being generally parallel to one another and adapted to be positioned in proximity to or to abut the inner surfaces of the glazing panels when in use, and wherein the inner flange walls have a configuration such that the distance between said inner flange walls becomes smaller away from said inner web whereby said groove-like region bounded by said inner flange walls and said inner web has a re-entrant shape to facilitate the securement to said flanges and over said inner web of a snap-on cap.

2. The spacer of claim 1 wherein the distance between said inner flange walls gradually decreases in a direction away from said inner web to define said re-entrant region.

3. The spacer of claim 1 wherein the distance between said inner flange walls decreases abruptly a selected distance away from the said inner web to define said re-entrant region.

4. The spacer of claim 3 wherein said inner flange walls define an abrupt step to provide said re-entrant region.

5. The spacer of claim 2 wherein said inner flange walls are inclined toward each other in a direction away from said inner web to provide said gradual decrease in distance.

6. The spacer of claim 2 wherein said inner flange walls each have a convex hump thereon to provide the gradual decrease in distance.

7. The spacer according to claim 1 wherein said tubular body includes a shoulder portion between each body side wall and the associated flange outer wall defining an inwardly directed step by way of which said body side walls are stepped inwardly of said flange outer walls.

8. The spacer according to claim 1 having at least one smoothly contoured right angle bend therein adapted to be located at a corner of a glazing unit between the glazing panels.

9. The spacer according to claim 1 wherein said cap has first portions to releasably secure said cap to said spacer body, and said inner flange walls define an abrupt step to provide said re-entrant region and wherein said cap is of a resilient nylon, neoprene or fiberglass material and wherein said first portions include opositely resilient lobes engaged with the abrupt steps defined by said inner flange walls to secure said cap in place, said cap defining an elongated cavity for retention of dessicant, and apertures in said cap for communicating a space between the glazing panels with the dessicant cavity.

10. The spacer of claim 1 wherein said inner and outer walls of both of said flanges are connected together only at said distal portions thereof.

11. The spacer of claim 1 wherein said spacer is formed from a single section of roll formed sheet metal.

12. The spacer according to claim 10 wherein both of said flange outer walls are spaced from both of said flange inner walls whereby to permit inward or outward motion of said flange outer walls during use in response to pressure fluctuations on glazing panels engaged with same, and said flanges being capable of flexing and pivoting relative to said body to accommodate flexure of glazing panels in contact therewith.

13. A combination of a glazing unit including a spaced pair of glazing panels and a spacer extending around the perimeter thereof between said panels and sealingly engaged therewith, said spacer including a tubular body having an inner web which faces inwardly toward the space between the panels and an outer web spaced from said inner web and which faces outwardly in the opposite direction away from the space between the panels, said spacer including first and second elongated flanges disposed at opposing sides of said tubular body in flanking relation to said inner web and each said flange having an inner and an outer wall, with a groove-like region being defined and bounded by said inner web and said inner flange walls, each said flange having a distal portion remote from said inner web and a proximal portion adjacent said inner web and said inner web extending fully across from said first flange to said second flange, said inner and outer walls of said flanges being connected together only at said distal portions thereof, and, at said proximal portion of said first flange, said inner wall of said first flange being connected only to said inner web, said tubular body further including a pair of opposed body side walls each of which extends between an associated flange outer wall and said outer web, and said body side walls being stepped inwardly of said flange outer walls, said outer flange walls being generally parallel to one another and adapted to be positioned in proximity to or to abut the inner surfaces of the glazing panels when in use, said spacer having a smoothly contoured right angle bend at each of the corners of the glazing unit and a snap-on cap overlying said inner web, said cap having resilient portions engaged with portions of said inner flange walls to secure said cap to the spacer body.

14. The glazing unit according to claim 13 further including a snap-on cap engaged with said flanges, said cap having a top wall overlying said inner web of the spacer body, a plurality of muntin bars arranged in a selected array between said glazing panels, and means in said top wall of said cap securing said muntin bars in position.

15. The glazing unit according to claim 14 wherein said means in said top wall comprises apertures receiving therein end portions of said muntin bars.

16. An elongated spacer adapted to be positioned between a pair of glazing panels adjacent the perimeter thereof, said spacer including a tubular body having an inner web which, in use, faces inwardly toward the space between the panels and an outer web spaced from said inner web and which, in use, faces outwardly in the panels, said spacer including first and second elongated flanges disposed at opposing sides of said tubular body in flanking relation to said inner web and each said flange having an inner and an outerwall, with a groove-like region being defined and bounded by said inner web and said and said inner flange walls, each said flange having a distal portion remote from said inner web and a proximal portion adjacent said inner web, and said inner web extending fully across from said first flange to said second flange, said inner and outer walls of at least said first flange being directly connected together only at said distal portion thereof, and, adjacent the proximal portion of said first flange, said inner wall of said first flange being connected only to said inner web, said tubular body further including a pair of opposed body side walls each of which extends between an associated flange outer wall and said outer web, said outer flange walls being generally parallel to one another and adapted to be positioned in proximity to or to abut the inner surfaces of the glazing panels when in use, and a snap-on cap overlying said inner web, said cap having first portions engaged with portions of said inner flange walls to releasably secure said cap to said spacer body.

17. The spacer according to claim 16 wherein said cap defines a space, said space being capable of holding a desiccant.

18. The spacer according to claim 16 wherein said cap includes a top wall, and said first portions including a pair of resilient legs extending therefrom in spaced apart relation, an outer distal end of each leg having an outwardly turned lip thereon adapted to engage with said inner flange wall portions and to co-operate therewith such that during installation or removal of the cap on the spacer body, said legs are caused to spring inwardly toward each other to provide a snap action.

19. The spacer according to claim 16 wherein said cap includes a top wall which extends from one said flange to the other, said cap further including downturned strips along longitudinal margins at the top wall and arranged to overlie at least substantial portions of said flange outer walls such that in use the strips are interposed between said flange outer walls and said glazing panels.

20. The spacer according to claim 19 wherein said cap is of a selected material and said downturned strips being a sufficient thickness that in use they provide thermal insulation and/or sound insulation betwen said glazing panels.

21. An elongated spacer adpated to be positioned between a pair of glazing panels adjacent the perimeter thereof, said spacer including a tubular body having an inner web which, in use, faces inwardly toward the space between the panels and an outer web spaced from said inner web and which, in use, faces outwardly in the opposite direction away from the space between the panels, said spacer including first and second elongated flanges disposed at opposing sides of said tubular body in flanking relation to said inner web and each said flange having an inner and an outer wall, said outer flange walls adapted to be positioned in proximity to or to abut the inner surfaces of the glazing panels when in use, with a groove-like region being defined and bounded by said inner web and said inner flange walls, each said flange having a distal portion remote from said inner web and a proximal portion adjacent said inner web, and said inner web extending fully across from one said flange to the other said flange, said inner and outer walls of at least said first flange being directly connected together only at said distal portion thereof, and, generally at said proximal portion of the first flange, said inner wall of said first flange being connected only to said inner web, said inner and outer walls of at least said first flange being capable of separating apart from one another except where they are connected together at said distal portion to permit movement of said outer wall of at least said first flange relative to said tubular body in response to movement or flexure of a glazing panel associated therewith, said tubular body further including a pair of opposed body side walls each of which extends between an associated flange outer wall and said outer web, and said body side walls being stepped inwardly of said flange outer walls and a snap-on cap secured to said flanges and over said groove.

22. The spacer of claim 21 wherein said inner and outer walls of both of said flanges are connected together only at said distal portions thereof with said inner and outer walls of both of said flanges being spaced apart from one another except where they are connected together at said distal portions thus enabling said outer walls of said flanges to move inwardly or outwardly and to pivot slightly in response to forces acting on and/or flexure of glazing panels in contact therewith.

23. The spacer of claim 22 formed from a single section of roll formed sheet metal.

24. The spacer of claim 21, wherein said tubular body together with said flanges defines a fully closed box-beam like structure.

25. The spacer of claim 24 including four right angle bends at sapced intervals to define a closed loop of rectangular outline, and a joint or joints between sections of said spacer being located in straight runs of the spacer between the bends.

* * * * *